US008651902B2

(12) United States Patent
Wu

(10) Patent No.: US 8,651,902 B2
(45) Date of Patent: Feb. 18, 2014

(54) WIRE-GRASPING STRUCTURE FOR TERMINAL BLOCK

(75) Inventor: Shang Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 79 days.

(21) Appl. No.: 13/413,983

(22) Filed: Mar. 7, 2012

(65) Prior Publication Data

US 2013/0237094 A1 Sep. 12, 2013

(51) Int. Cl.
*H01R 4/36* (2006.01)

(52) U.S. Cl.
USPC ..... 439/811; 439/709

(58) Field of Classification Search
USPC ..... 439/709, 810–814
See application file for complete search history.

(56) References Cited

U.S. PATENT DOCUMENTS 4,070,086 A * 1/1978 Trafford ..... 439/717
4,669,806 A * 6/1987 Fuchs ..... 439/712
5,664,971 A * 9/1997 Coy ..... 439/811
6,280,264 B1 * 8/2001 Whipple et al. ..... 439/814
6,475,038 B1 * 11/2002 Franck ..... 439/811
6,764,355 B2 * 7/2004 Ude et al. ..... 439/811
6,945,527 B2 * 9/2005 Guddanti et al. ..... 271/147
7,387,547 B1 * 6/2008 Fuzetti ..... 439/798
7,404,745 B1 * 7/2008 Wu ..... 439/811
7,798,869 B1 * 9/2010 Konopacki et al. ..... 439/812

* cited by examiner

*Primary Examiner* — Thanh Tam Le
(74) *Attorney, Agent, or Firm* — Birch, Stewart, Kolasch & Birch, LLP

(57) ABSTRACT

A wire-grasping structure for a terminal block is disclosed. The wire-grasping structure includes a core, a conductive terminal piece and a screw. The core is transversely formed with a socket and vertically formed with a threaded hole. The socket and the threaded hole are communicated mutually and each communicated with the exterior of the core. The conductive terminal piece has a receiving portion and a terminal portion. The terminal portion is configured to be horizontally inserted into the socket such that the receiving portion projects from the core terminal portion. The screw is configured to be vertically screwed in to the threaded hole and enter the socket to abut against the terminal portion. Thereby, the wire-grasping structure can store a jumper bar and facilitate convenient use.

5 Claims, 6 Drawing Sheets

WIRE-GRASPING STRUCTURE FOR TERMINAL BLOCK

BACKGROUND OF THE INVENTION

1. Technical Field

The present invention relates to terminal blocks of electronic devices, and more particularly, to a wire-grasping structure for a terminal block, wherein the wire-grasping structure allows convenient storage of a jumper bar.

2. Description of Related Art

Terminal blocks are widely used in electronic devices for wire connection. A typical terminal block is a combination of several wire-grasping structures each grasping a circuit wire for electrical connection with other electronic components.

In general electronic devices, wiring is subject to change in order to provide different functions. In other words, some circuit wires connected to the terminal block have sometimes to be formed as an open circuit and some other times have to be formed as a short circuit. For achieving the desired short circuit, a jumper bar is inserted into the circuit wire on which the short circuit is to be made.

However, the existing wire-grasping structure is configured without a place for storing the jumper bar. In other words, the jumper bars not in use are usually scattered aside to mess up the working space. In addition, the jumper bars placed without care tend to be lost, causing inconvenience to the operator. Therefore, an improvement made thereto is desired.

SUMMARY OF THE INVENTION

The present invention provides a wire-grasping structure for a terminal block. The wire-grasping structure includes a core, a conductive terminal piece and a screw.

The core is transversely formed with a socket and vertically formed with a threaded hole. The socket and the threaded hole are communicated mutually and each communicated with the exterior of the core. The conductive terminal piece has a receiving portion and a terminal portion. The terminal portion is configured to be horizontally inserted into the socket such that the receiving portion projects from the core terminal portion. The screw is configured to be vertically screwed in to the threaded hole and enter the socket to abut against the terminal portion.

Thereby, the wire-grasping structure such configured can fittingly store a jumper bar and, in turn, facilitates convenient use.

The receiving portion has two openings that are not communicated with each other.

The wire-grasping structure further comprises a base that is vertically formed with an accommodating space and a through hole, and transversely formed with a window, wherein the accommodating space, the through hole and the window are communicated with one another and each communicated with the exterior of the base, in which the core is configured to be received in the accommodating space such that the socket is aligned and communicated with the window and the threaded hole is aligned and communicated with the through hole, thereby allowing the screw to be vertically screwed into the threaded hole through the through hole.

The base comprises a shoulder that is adjacent to the accommodating space and is for the conductive terminal piece to rest thereupon.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 1:
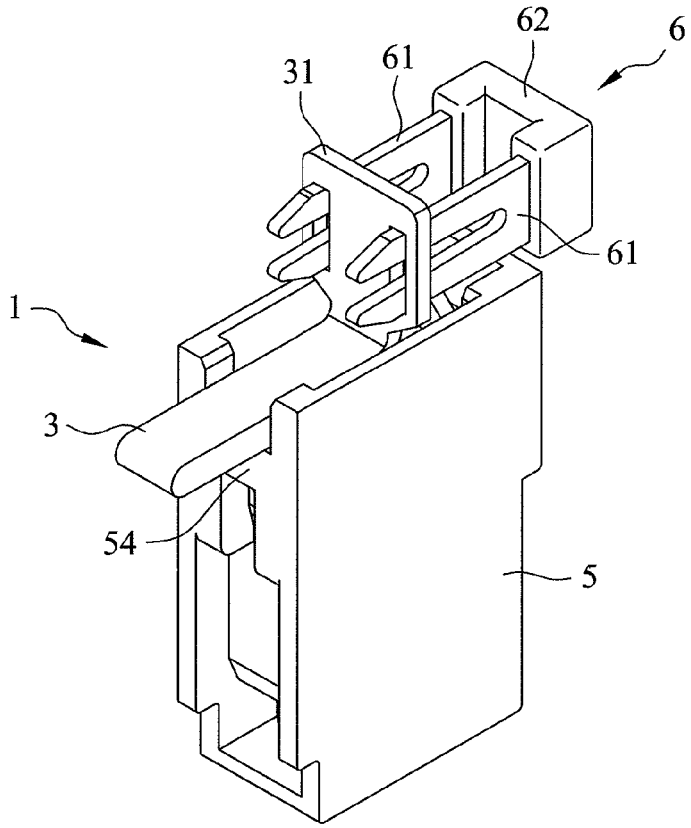
FIG. 1 a perspective view of a wire-grasping structure according to the present invention combined with a jumper bar.
Figure 2:
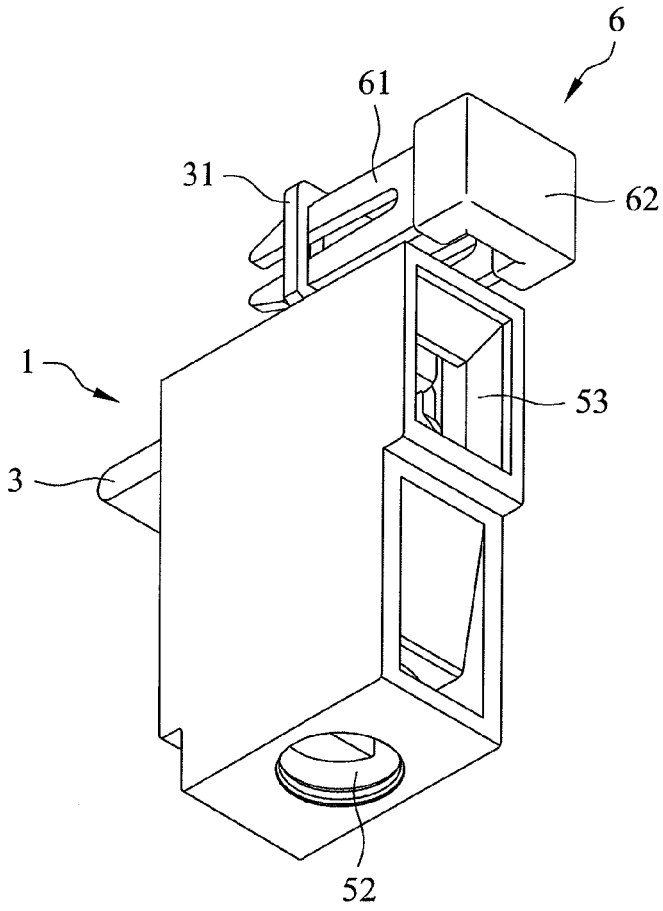
FIG. 2 is a perspective view of the combination of FIG. 1 from another viewpoint.
Figure 3:
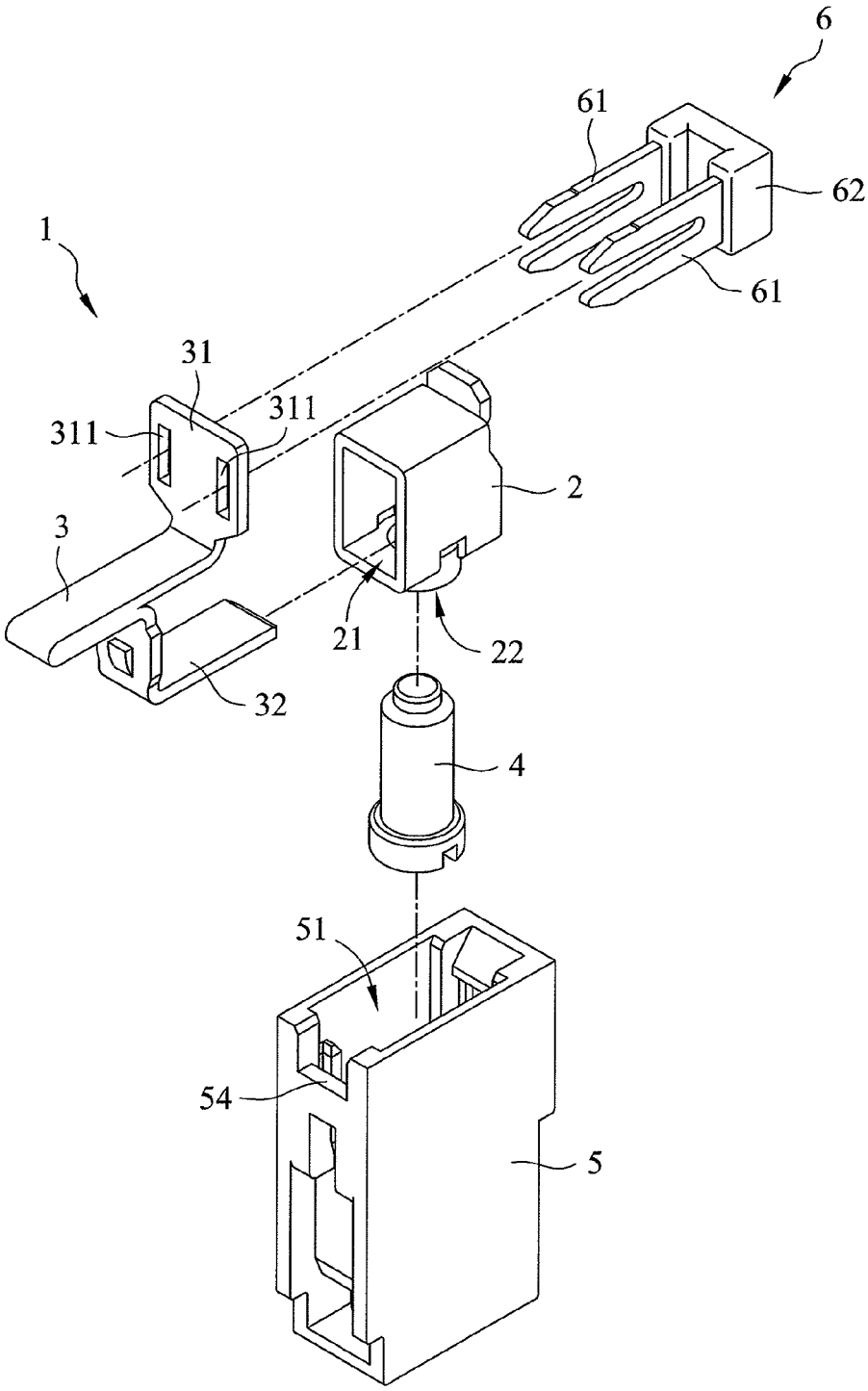
FIG. 3 is an exploded view of the combination of FIG. 1.
Figure 4:
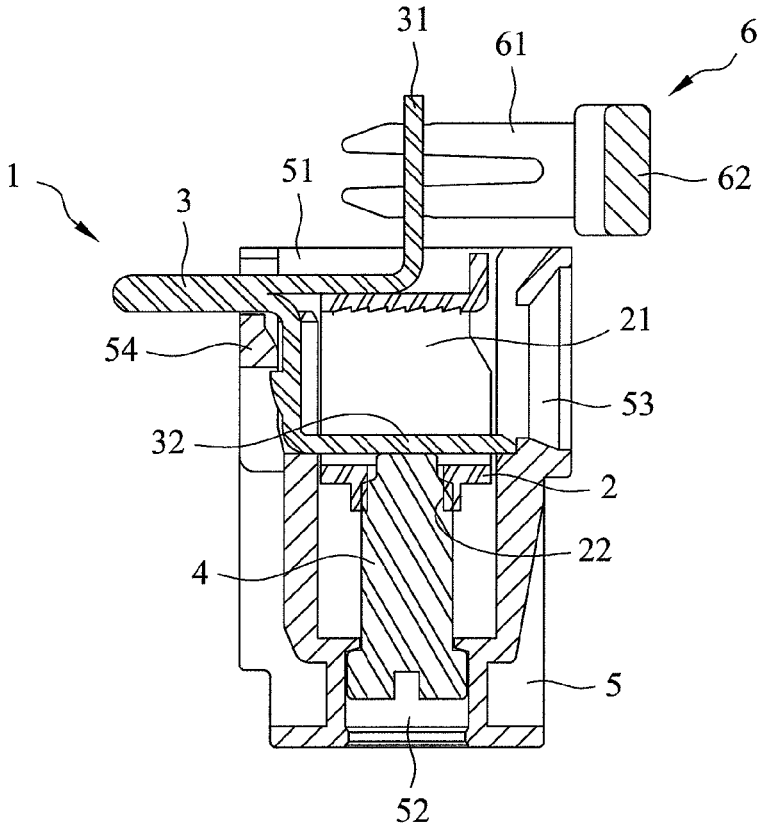
FIG. 4 is a cross-sectional view of the combination of FIG. 1.

FIG. 1 through FIG. 4 are made for illustrating one embodiment of the present invention. FIG. 1 a perspective view of a wire-grasping structure according to the present invention combined with a jumper bar. FIG. 2 is a perspective view of the combination of FIG. 1 from another viewpoint. FIG. 3 is an exploded view of the combination of FIG. 1. FIG. 4 is a cross-sectional view of the combination of FIG. 1.

The depicted wire-grasping structure 1 comprises a core 2, a conductive terminal piece 3 and a screw 4.

As shown, the core 2 is transversely formed with a socket 21 and vertically formed with a threaded hole 22. The socket 21 and the threaded hole 22 are communicated mutually and each communicated with the exterior of the core 2. The conductive terminal piece 3 has a receiving portion 31 and a terminal portion 32. The terminal portion 32 is configured to be horizontally inserted into the socket 21 of the core 2 such that the receiving portion 31 projects from the core 2 when they are assembled. The screw 4 is vertically screwed to the threaded hole 22 of the core 2 and enters the socket 21 to abut against the terminal portion 32 of the conductive terminal piece 3.

In the present embodiment, the receiving portion 31 is an upward bent portion of the conductive terminal piece 3 and is formed with two openings 311 that are not communicated with each other.

Additionally, in the present embodiment, also provided is a base 5, which is vertically formed with an accommodating space 51 and a through hole 52, and is transversely formed with a window 53. The accommodating space 51, the through hole 52 and the window 53 are communicated with one another and each communicated with the exterior of the base 5.

The core 2 is configured to be received in the accommodating space 51 of the base 5, such that the socket 21 is aligned and communicated with the window 53 and the threaded hole 22 is aligned and communicated with the through hole 52, allowing the screw 4 to be screwed into the threaded hole 22 through the through hole 52.

The base 5 is further designed with a shoulder 54 that is adjacent to the accommodating space 51 for the conductive terminal piece 3 to rest thereon, thereby reliably supporting the conductive terminal piece 3.

When the wire-grasping structure 1 is used for its purpose, a circuit wire (not shown) is inserted into the socket 21 of the core 2 through the window 53 of the base 5 such that it comes into contact with the terminal portion 32 of the conductive terminal piece 3. Afterward, the screw 4 is screwed into the socket 21 to abut against the terminal portion 32, so when the screw 4 rotates, the rotating force drives the core 2 to move and makes the core 2 hold the circuit wire and the terminal portion 32 firmly.

With the foregoing configuration, a jumper bar 6, when not in use, can be positioned by the receiving portion 31 as an upward bent portion of the conductive terminal piece 3, and, as described in detail below, can be easily detached from the receiving portion 31 for use.

Figure 5:
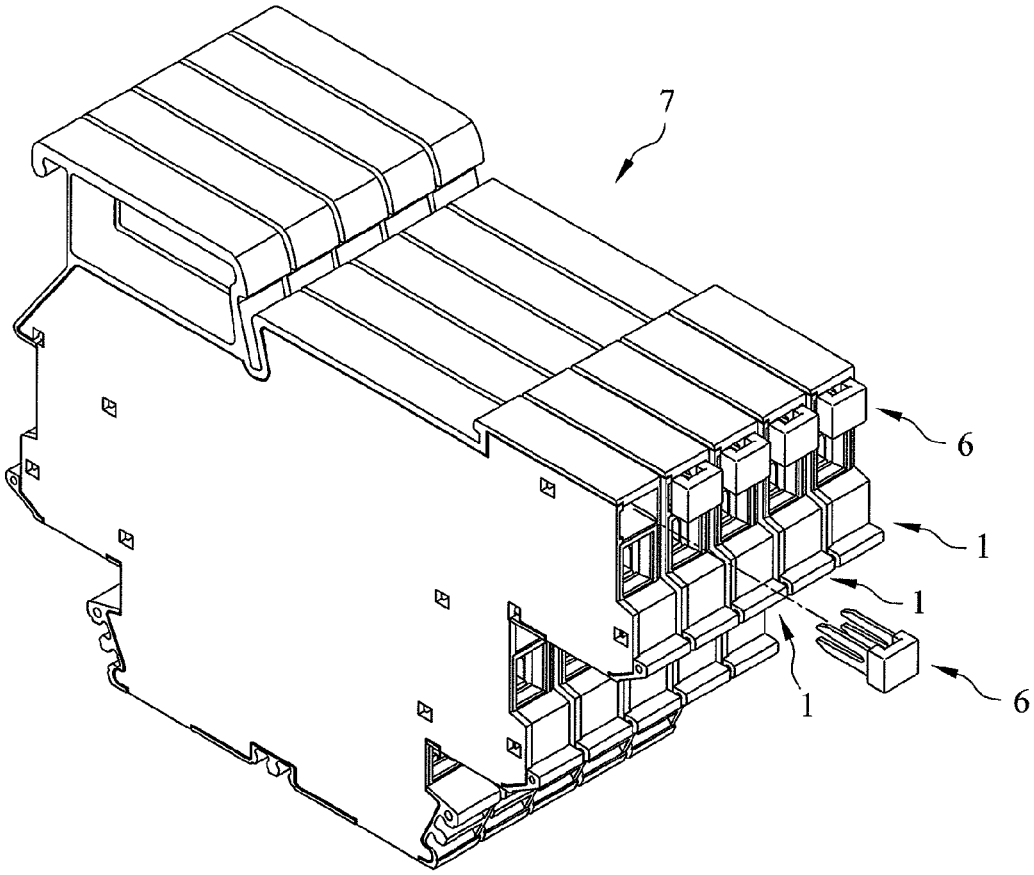
FIG. 5 and FIG. 6 are applied views of the wire-grasping structure according to the present invention.
Figure 6:
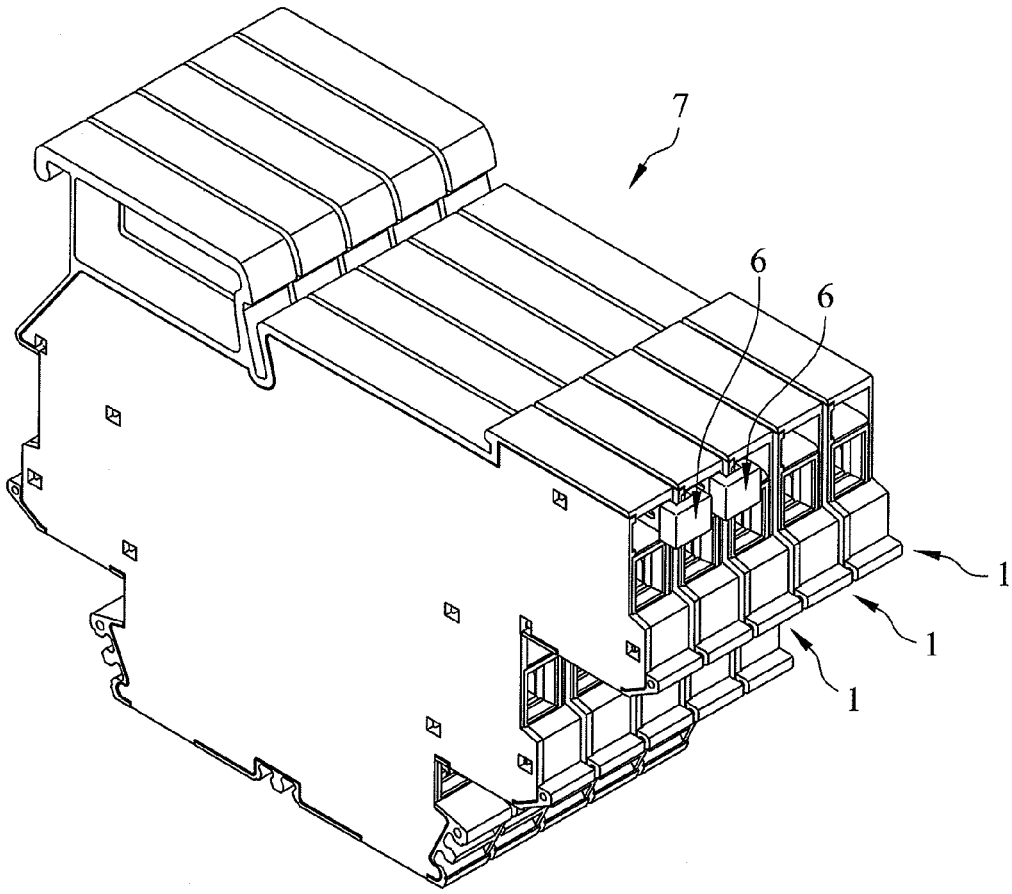

In addition to FIGS. 1 through 4, please also refer to FIG. 5 and FIG. 6 for applied views of the wire-grasping structure according to the present invention.

Referring to FIG. 5 and FIG. 6, a terminal block 7 is composed of plural said wire-grasping structures 1 arranged abreast.

The jumper bar 6 has two bent pins 61 and is covered by a plastic coating 62.

As shown in FIG. 5, when not used to form a short circuit, the jumper bar 6 can be retained by the receiving portion 31 of the conductive terminal piece 3 by inserting its two pins 61 into the two openings 311 of the receiving portion 31.

Then, as shown in FIG. 6, when to be used to form a short circuit, the jumper bar 6 can be withdrawn from the receiving portion 31 of the conductive terminal piece 3, and inserted in to the corresponding wire-grasping structure 1.

Thus, as described above, with the novel configuration, the wire-grasping structure 1 features the ability to store the jumper bar 6, thereby improving convenience in use. For example, the jumper bar 6 well stored will not be lost when not in use.

It is to be noted that the terminal block 7 depicted in FIG. 5 and FIG. 6 is merely an example for illustration, and may be embodied in to various forms. A terminal block composed of plural said wire-grasping structures 1 arranged into a circular configuration is also one exemplary example suitable for the present invention.

What is claimed is:

1. A wire-grasping structure for a terminal block, the wire-grasping structure comprising:

a core that is transversely formed with a socket and vertically formed with a threaded hole, wherein the socket and the threaded hole are communicated mutually and each communicated with an exterior of the core;

a conductive terminal piece that comprises a receiving portion and a terminal portion, wherein the terminal portion is configured to be horizontally inserted into the socket such that the receiving portion projects from the core; and a screw that is configured to be vertically screwed into the threaded hole and enter the socket to abut against the terminal portion of the conductive terminal piece, wherein the receiving portion includes two openings, not communicating with each other, configured to be inserted by two pins of a jumper bar, respectively, so as to rest the jumper bar.

2. The wire-grasping structure of claim 1, further comprising a base that is vertically formed with an accommodating space and a through hole, and transversely formed with a window, wherein the accommodating space, the through hole and the window are communicated with one another and each communicated with an exterior of the base, in which the core is configured to be received in the accommodating space such that the socket is aligned and communicated with the window and the threaded hole is aligned and communicated with the through hole, thereby allowing the screw to be vertically screwed into the threaded hole through the through hole.

3. The wire-grasping structure of claim 2, wherein the base comprises a shoulder that is adjacent to the accommodating space and is for the conductive terminal piece to rest thereupon.

4. The wire-grasping structure of claim 1, wherein the two openings are two closed openings that are independent of each other.

5. The wire-grasping structure of claim 1, further comprising a base structure accommodating the core, the screw and the conductive terminal piece, wherein the base structure has a top surface, and the receiving portion has a shoulder resting on the top surface of the base structure; and wherein the two openings are exposed outside the base structure, and in their entirety, above the top surface of the base structure.

* * * * *